US011930875B2

(12) United States Patent
Kasraei

(10) Patent No.: US 11,930,875 B2
(45) Date of Patent: Mar. 19, 2024

(54) IMPACT REDUCTION SYSTEM FOR PERSONAL PROTECTIVE DEVICES

(71) Applicant: John Hooman Kasraei, Walnut, CA (US)

(72) Inventor: John Hooman Kasraei, Walnut, CA (US)

( * ) Notice: Subject to any disclaimer, the term of this patent is extended or adjusted under 35 U.S.C. 154(b) by 99 days.

(21) Appl. No.: 17/862,665

(22) Filed: Jul. 12, 2022

(65) Prior Publication Data

US 2023/0010714 A1 Jan. 12, 2023

Related U.S. Application Data

(60) Provisional application No. 63/220,561, filed on Jul. 12, 2021.

(51) Int. Cl.
*A42B 3/06* (2006.01)
*A42B 3/12* (2006.01)

(52) U.S. Cl.
CPC ..... *A42B 3/06* (2013.01)

(58) Field of Classification Search
CPC ..... A42B 3/06; A42B 3/121
See application file for complete search history.

(56) References Cited

U.S. PATENT DOCUMENTS 3,787,893 A * 1/1974 Larcher ..... A42B 3/121 2/413
4,823,482 A * 4/1989 Lakic ..... A42B 3/121 36/117.3
5,813,142 A * 9/1998 Demon ..... A43B 13/206 600/592
7,713,421 B2 5/2010 Galbraith
7,774,866 B2 8/2010 Ferrara
8,733,903 B2 5/2014 Gao et al.
8,739,317 B2 6/2014 Abernethy
9,038,652 B1 5/2015 Henry
9,289,023 B2 * 3/2016 Archbold ..... F41H 1/04
9,314,061 B2 4/2016 Hanson et al.
9,380,823 B2 7/2016 Johnson
9,451,795 B2 9/2016 Krueger
9,462,842 B2 10/2016 Hoshizaki et al.
9,820,524 B1 * 11/2017 Whitcomb ..... A63B 71/12
9,903,536 B2 * 2/2018 Lin ..... F15B 13/027

(Continued)

FOREIGN PATENT DOCUMENTS

CN 112790469 A 5/2021
CN 112932008 A 6/2021

(Continued)

*Primary Examiner* — Robert H Muromoto, Jr.
(74) *Attorney, Agent, or Firm* — Thomas E. Lees, LLC

(57) ABSTRACT

Personal protective devices with an impact reduction system that includes a first bladder system including a fluid and a second bladder system are disclosed. A passage couples the first bladder system to the second bladder system and includes a first series of Tesla valves that resist flow of the fluid from the first bladder system to a common point of the passageway when an impact occurs to the first bladder system. In some embodiments, the passage further includes a second series of Tesla valves that resist flow of the fluid from the second bladder system to the common point of the passageway when an impact occurs to the second bladder system. The impact reduction system is a passive, closed system.

20 Claims, 10 Drawing Sheets

(56) References Cited

U.S. PATENT DOCUMENTS

| | | | | |
|---|---|---|---|---|
| 9,970,505 | B2 * | 5/2018 | Teraoka | F16F 9/187 |
| 10,278,445 | B1 * | 5/2019 | Whitcomb | A42B 3/12 |
| 10,863,792 | B2 | 12/2020 | Auyang et al. | |
| 11,247,115 | B2 * | 2/2022 | Blecher | A42B 3/225 |
| 11,280,426 | B2 | 3/2022 | Murison | |
| 2009/0019728 | A1 * | 1/2009 | Roth | A43B 7/22 36/91 |
| 2011/0139453 | A1 | 6/2011 | Schultz et al. | |
| 2011/0252544 | A1 * | 10/2011 | Abernethy | A42B 3/122 2/413 |
| 2013/0042397 | A1 | 2/2013 | Halldin | |
| 2013/0152287 | A1 | 6/2013 | Cormier et al. | |
| 2015/0135550 | A1 * | 5/2015 | Gishifu | A43B 13/189 36/29 |
| 2017/0172242 | A1 | 6/2017 | Leatt et al. | |
| 2018/0317589 | A1 * | 11/2018 | Mestas | A42B 3/064 |
| 2019/0001187 | A1 | 1/2019 | Costella et al. | |
| 2019/0104798 | A1 * | 4/2019 | Podboy | A42B 3/0433 |
| 2019/0261721 | A1 | 8/2019 | Hoshizaki et al. | |
| 2020/0046056 | A1 | 2/2020 | Hawkes et al. | |
| 2020/0221807 | A1 * | 7/2020 | Morgan | A42B 3/121 |
| 2022/0079813 | A1 | 3/2022 | Lawrence et al. | |
| 2023/0081283 | A1 * | 3/2023 | Langvin | F16K 15/1848 |

FOREIGN PATENT DOCUMENTS

| | | | |
|---|---|---|---|
| EP | 2520368 | A1 | 11/2012 |
| RU | 2598125 | C1 | 9/2016 |
| WO | 2018234876 | A1 | 12/2018 |
| WO | WO-2018234876 | A1 * | 12/2018 |
| WO | 2021043207 | A1 | 3/2021 |

* cited by examiner

IMPACT REDUCTION SYSTEM FOR PERSONAL PROTECTIVE DEVICES

CROSS REFERENCE TO RELATED APPLICATIONS

This application claims the benefit of U.S. Provisional Patent Application Ser. No. 63/220,561, filed Jul. 12, 2021, entitled Apparel Based Damping System, by John Hooman Kasraei, the disclosure of which is hereby incorporated herein by reference.

BACKGROUND

Various aspects of the present invention relate generally to protective clothing and more specifically to protective clothing using a fluid damping system to reduce impacts.

Occupational and recreational activities occasionally include dangers of outside impacts on a person. As such, people often wear personal protective devices to reduce a severity of an impact. For example, a construction worker may wear a helmet to prevent an effect of an impact to their head. As another example, a motorcyclist may wear a helmet to reduce impacts during an accident. As a further example of personal protective devices, some people may want to reduce impacts of their feet on the ground while running, so those people may wear shoes that reduce impacts.

BRIEF SUMMARY

According to aspects of the present invention, a personal protective device with an impact reduction system includes a first bladder system including a fluid and a second bladder system. A passageway couples the first bladder system to the second bladder system and includes a first series of Tesla valves that resist flow of the fluid from the first bladder system to a common point of the passageway when an impact occurs to the first bladder system. The passageway further includes a second series of Tesla valves that resist flow of the fluid from the second bladder system to the common point of the passageway when an impact occurs to the second bladder system. The impact reduction system is a passive, closed system.

According to further aspects of the present disclosure, a helmet comprises a hard shell with an exterior surface and an interior. The helmet further comprises an impact reduction system comprising a first bladder system in the interior of the shell, where the first bladder system includes a fluid and a second bladder system. A first passageway couples the first bladder system to the second bladder system, wherein the first passageway includes a series of Tesla valves that resist flow of the fluid from the first bladder system to the second bladder system when an impact occurs to the first bladder system. Further, a second passageway couples the first bladder system to the second bladder system, wherein the second passageway includes a series of Tesla valves that resist flow of the fluid from the second bladder system to the first bladder system after the fluid has passed to the first bladder system.

According to more aspects of the present disclosure, a helmet comprises a hard shell with an exterior surface and an interior. The helmet further comprises an impact reduction system with a first bladder system in the interior of the shell, where the first bladder system includes a fluid and a second bladder system, wherein the second bladder system is disposed on the exterior surface of the helmet. A passageway that couples the first bladder system to the second bladder system, wherein the passageway includes a series of Tesla valves that resist flow of the fluid from the first bladder system to the second bladder system when an impact occurs to the first bladder system.

The impact reduction systems discussed herein may be used in many different form of personal protective equipment include helmets, shoes, body armor, etc.

DETAILED DESCRIPTION

According to aspects of the present disclosure, personal protective devices are equipped with impact reduction systems that include bladder systems, where at least one of the bladder systems includes a fluid. A series of Tesla valves creates a passageway to connect the bladder system with the fluid to an empty bladder system. A Tesla valve is a check valve that does not require outside control, allowing fluid to flow relatively freely in one direction. However, flow in an opposite direction is fed back upon itself, which impedes flow in that opposite direction. Therefore, more pressure is required to have the fluid flow in one direction than the other direction. As it takes more pressure to flow in one direction, the fluid will remain in the fluid-filled bladder system until a force acts upon the fluid-filled bladder system, at which point, the fluid will be transported from the fluid-filled bladder system to the empty bladder system. Embodiments of the Tesla valve in general are well known in the industry.

As the passageway resists the fluid flowing to the empty bladder system, the fluid-filled bladder system empties at a slower rate than if the passageway were a regular tube. Thus, when an impact occurs on the fluid-filled bladder system, a change in momentum of the impact is spread out over a longer time, which reduces the force of the impact. Moreover, the impact reduction system is a closed system. Thus, all exits of the passageway(s) couple to a bladder system of some sort. In other words, none of the exits of the passageway(s) are open to the air.

As mentioned above, the impact reduction systems may be used in personal protective devices and other devices to reduce force of impacts while allowing the impact reduction systems to be reset and used again by forcing the fluid back to the fluid-filled bladder system. The size of the Tesla valve (e.g., cross sectional channel), the number of Tesla valves, and type of fluid used all affect an amount of impact dampening that may occur when a bladder system is impacted.

Figure 1:
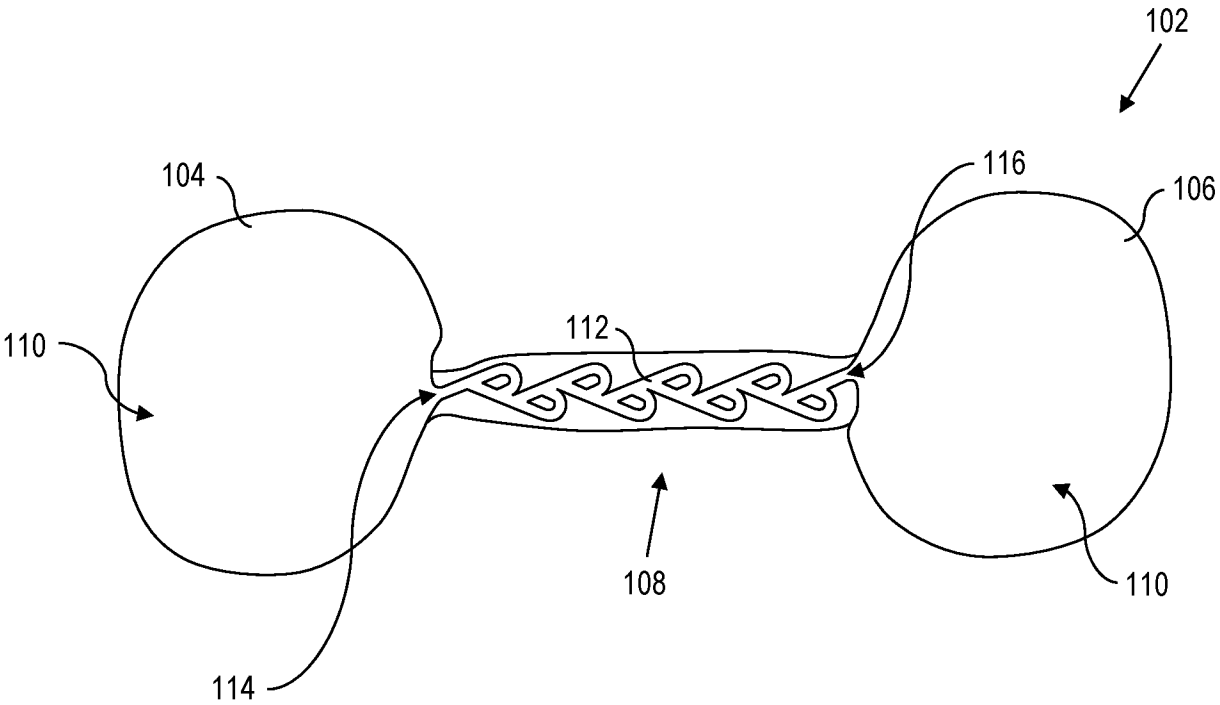
FIG. 1 is a drawing illustrating an embodiment of an impact reduction system for use in personal protective equipment, where the impact reduction system includes two bladder systems coupled by a passageway to allow flow from one bladder system to the other bladder system, according to aspects of the present disclosure.

Turning now to the figures, and in particular FIG. 1, an embodiment of an impact reduction system 102 is shown. The impact reduction system 102 includes a first bladder system 104 and a second bladder system 106 coupled together by a passageway 108. The first bladder system 104 is shown as a single bladder, but any number of bladders may be used in the first bladder system 104. Further, the second bladder system 106 is shown as a single bladder, but any number of bladders may be used in the second bladder system 106. The first bladder system 104 also includes a fluid 110 that fills a portion of the first bladder system 104 or an entirety of the first bladder system 104. Moreover, the fluid 110 may be any fluid (e.g., water, oils, other liquids, air, etc.). Likewise, the second bladder system 106 may be entirely empty or include a fluid that fills a portion of the second bladder system 106. Moreover, multiple passageways 108 may be used to connect the first bladder system 104 to the second bladder system 106.

The passageway 108 includes a series of Tesla valves 112 that restrict flow of the fluid 110 from the first bladder system 104 to the second bladder system 106 (as discussed above). Further, the passageway includes an inlet 114 (coupling to the first bladder system 104) and an outlet 116 (coupling to the second bladder system 106). In some embodiments, the passageway 108 also includes a check valve, a slit cap, or other type of passive flow preventer to prevent the fluid 100 from easily leaking from the second bladder system 106 back to the first bladder system 104.

If the first bladder system 104 includes multiple bladders, then the passageway 108 may be multiple inlets to one outlet, there may be multiple passageways each with a single inlet and outlet, or both. Similarly, if the second bladder system 106 includes multiple bladders, then the passageway 108 may be one inlet to multiple outlets, there may be multiple passageways each with a single inlet and outlet, or both. Likewise, there can be a combination of the two above if there are multiple bladders in both the first bladder system and the second bladder system.

As mentioned above, when a force is applied to the first bladder system 106, the fluid 110 passes through the inlet 114 of the passageway 108 to the series of Tesla valves 112 to the outlet 116 of the passageway 108 to the second bladder system 106. The resistance of the Tesla valves to the flow of the fluid 110 extends the time of the change in momentum to reduce the force of the impact. To reset the impact reduction system 102, a force (which may be much less than the impact force) is applied to the second bladder system 106, and the fluid returns to the first bladder system.

Figure 2:
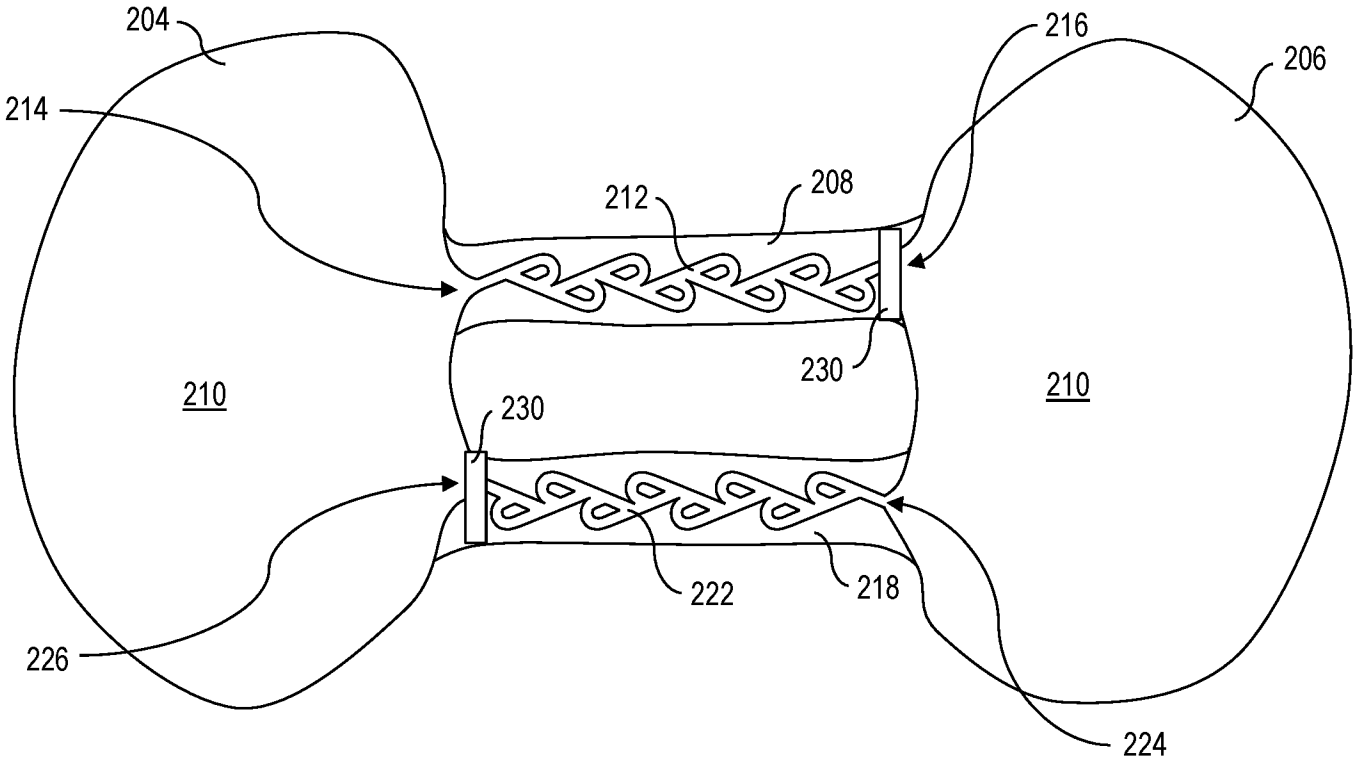
FIG. 2 is a drawing illustrating an embodiment of an impact reduction system for use in personal protective equipment, where the impact reduction system includes two bladder systems coupled by a dual passageway to allow flow from one bladder system to the other bladder system, according to aspects of the present disclosure.

Turning now to FIG. 2, another embodiment of the impact reduction system 202 is shown. Similar to the embodiment shown in FIG. 1, the impact reduction system 202 of FIG. 2 includes a first bladder system 204 and a second bladder system 206 coupled together by a first passageway 208. The first bladder system 204 is shown as a single bladder, but any number of bladders may be used in the first bladder system 204. Further, the second bladder system 206 is shown as a single bladder, but any number of bladders may be used in the second bladder system 206. The first bladder system 204 also includes a fluid 210 that fills a portion of the first bladder system 204 or an entirety of the first bladder system 204. Moreover, the fluid 210 may be any fluid (e.g., water, oils, other liquids, air, etc.). Likewise, the second bladder system 206 may be entirely empty or include a fluid that fills a portion of the second bladder system 206.

However, in the embodiment of FIG. 2, there is a second passageway 218 that restricts flow of the fluid 210 in an opposite direction from the flow of the first passageway 108. Thus, the second passageway 218 also includes a series of Tesla valves 222, an inlet 224, and an outlet 226. Further, both passageways 208, 218 include a flow preventor 230 (e.g., check valve, slit cap, etc.) that prevents flow in the non-restricted flow direction.

If the first bladder system 204 includes multiple bladders, then the first passageway 208 may be multiple inlets to one outlet, there may be multiple passageways each with a single inlet and outlet, or both. Similarly, if the second bladder system 106 includes multiple bladders, then the second passageway 108 may be one inlet to multiple outlets, there may be multiple passageways each with a single inlet and outlet, or both. Likewise, there can be a combination of the two above if there are multiple bladders in both the first bladder system and the second bladder system.

In embodiments where there is fluid in both the first bladder system and the second bladder system, an impact on either bladder system will cause the fluid to flow through the passageway associated with the bladder system to the other bladder system. In most embodiments, the bladder systems 204, 206 are made from a material with elastic properties such that an inside volume of the bladder increases when more pressure is added. Thus, in systems that have filled bladder systems 204, 206, the fluid can flow to a non-impacted bladder.

Figure 3:
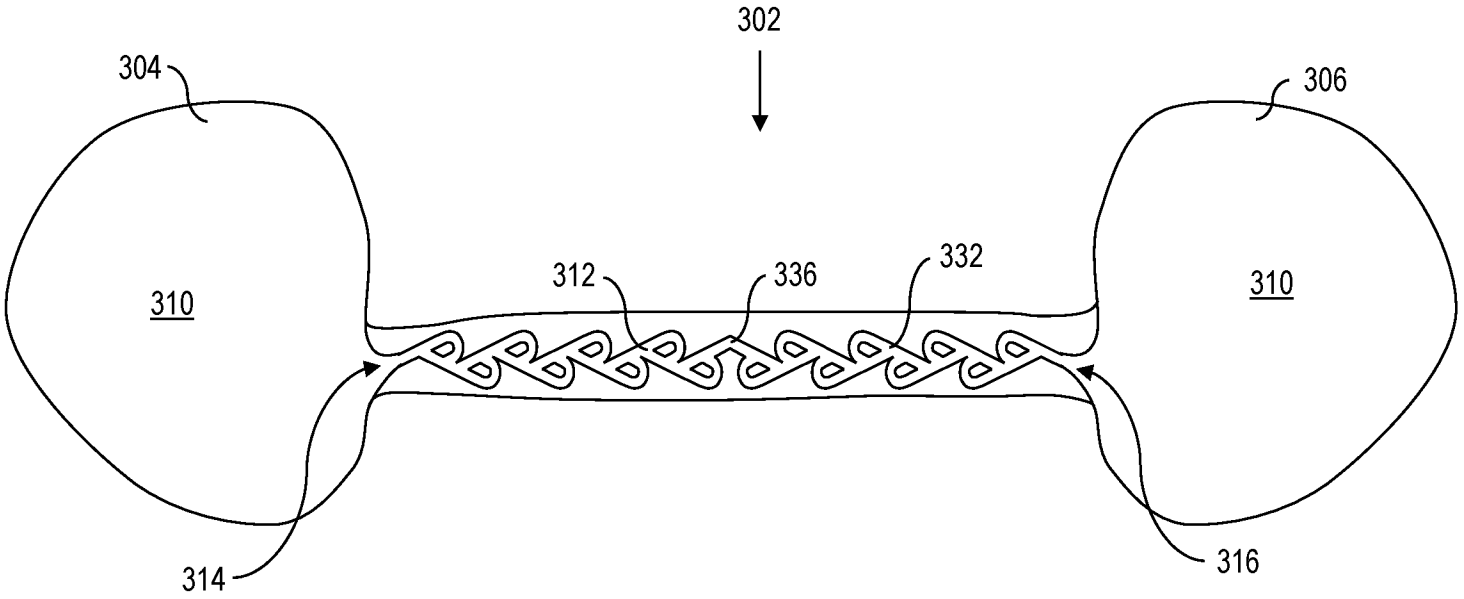
FIG. 3 is a drawing illustrating an embodiment of an impact reduction system for use in personal protective equipment, where the impact reduction system includes two bladder systems coupled by a passageway with two series of Tesla valves in opposite directions to allow flow from one bladder system to the other bladder system, according to aspects of the present disclosure.

Turning now to FIG. 3, another embodiment of the impact reduction system 302 is shown. The impact reduction system 302 includes a first bladder system 304 and a second bladder system 306 coupled together by a passageway 308. The first bladder system 304 is shown as a single bladder, but any number of bladders may be used in the first bladder system 304. Further, the second bladder system 306 is shown as a single bladder, but any number of bladders may be used in the second bladder system 306. The first bladder system 304 also includes a fluid 310 that fills a portion of the first bladder system 304 or an entirety of the first bladder system 304. Moreover, the fluid 310 may be any fluid (e.g., water, oils, other liquids, air, etc.). Likewise, the second bladder system 306 may be entirely empty or include a fluid that fills a portion of the second bladder system 306. Further, in most embodiments, the bladder systems 304, 306 are made from a material with elastic properties such that an inside volume of the bladder increases when more pressure is added. Thus, in systems that have filled bladder systems 304, 306, the fluid can flow to a non-impacted bladder. Moreover, multiple passageways 308 may be used to connect the first bladder system 304 to the second bladder system 306.

The passageway 308 includes a first series of Tesla valves 312 that restrict flow of the fluid 310 from the first bladder system 304 to the second bladder system 306 (as discussed above). Moreover, the passageway 308 includes a second series of Tesla valves oriented in an opposite direction of the first series of Tesla valves 312. The first series of Tesla valves 312 and the second series of Tesla valves 332 couple together at a common point 336 within the passageway 308 (e.g., halfway). Thus, the flow from the first bladder system 304 is restricted in the first series of Tesla valves 312 but allowed to freely flow through the second series of Tesla valves 332 once the fluid 310 reaches the second series of Tesla valves 332, and vice-versa. Thus, with a single passage 308, flow is restricted in both directions by the two series of Tesla valves 312, 332 oriented in opposite directions. While FIG. 3 illustrates the first and second series of Tesla valves 312, 332 restricting flow to the common point 336, the first and second series of Tesla valves 312, 332 may alternately restrict flow away from the common point 336 instead.

Similar to the embodiments above, if the first bladder system 304 includes multiple bladders, then the passageway 308 may be multiple inlets to one outlet, there may be multiple passageways each with a single inlet and outlet, or both. Similarly, if the second bladder system 306 includes multiple bladders, then the passageway 308 may be one inlet to multiple outlets, there may be multiple passageways each with a single inlet and outlet, or both. Likewise, there can be a combination of the two above if there are multiple bladders in both the first bladder system and the second bladder system Turning now to FIG. 4, a further embodiment of the impact reduction system 402 is shown. The impact reduction system 402 includes a first bladder system 404 and a second bladder system 406 coupled together by a passageway 408. The first bladder system 404 is shown as a single bladder, but any number of bladders may be used in the first bladder system 404. Further, the second bladder system 406 is shown as a single bladder, but any number of bladders may be used in the second bladder system 406. Moreover, in FIG. 4, there is a third bladder system 434 shown as a single bladder, but any number of bladders may be used in the third bladder system 434.

The first bladder system 404 also includes a fluid 410 that fills a portion of the first bladder system 404 or an entirety of the first bladder system 404. Moreover, the fluid 410 may be any fluid (e.g., water, oils, other liquids, air, etc.). Likewise, the second and third bladder systems 406, 434 may be entirely empty or include a fluid that fills a portion of the second and third bladder system 406, 434. Further, in most embodiments, the bladder systems 404, 406, 434 are made from a material with elastic properties such that an inside volume of the bladder increases when more pressure is added. Thus, in systems that have filled bladder systems 404, 406, 434 the fluid can flow to a n on-impacted bladder.

The passageway 408 has three portions 408*a*, 408*b*, 408*c* that radiate outward from a common point 436. The first bladder system 404 is coupled to the first portion 408*a* of the passageway; the second bladder system 406 is coupled to the second portion 408*b* of the passageway; and the third bladder system 434 is coupled to the third portion 408*c* of the passageway. Each portion 408*a-c* has a series of Tesla valves 412*a-c*, respectively, that restrict flow of the fluid 410 from the bladder systems associated with that passageway portion 408*a-c* to the common point 436. Once fluid reaches the common point 436, the fluid can flow to the other bladder systems. For example, if an impact occurs on the first bladder system 404, the fluid 410 flows from the first bladder system 404 through the first portion of the passageway 408*a* being restricted by the first series of Tesla valves 412*a*. Once the fluid 410 reaches the common point 436, the fluid 410 flows through the second, third, or both portions of the passageway 408*b*, 408*c* to the second, third, or both bladder systems 406, 434. As another example, if an impact occurs on the first and second bladder systems 404, 406 the fluid 410 flows from the first and second bladder systems 404, 406 through the first portion 408*a* and the second portion 408*b* of the passageway 408 being restricted by the first and second series of Tesla valves 412*a-b*, respectively. Once the fluid 410 reaches the common point 436, the fluid 410 flows through the third portion 408*c* of the passageway to the third bladder system 434.

As with the embodiments above, the impact reduction system 402 can be reset by applying pressure to the overly filled bladder system(s).

Figure 4:
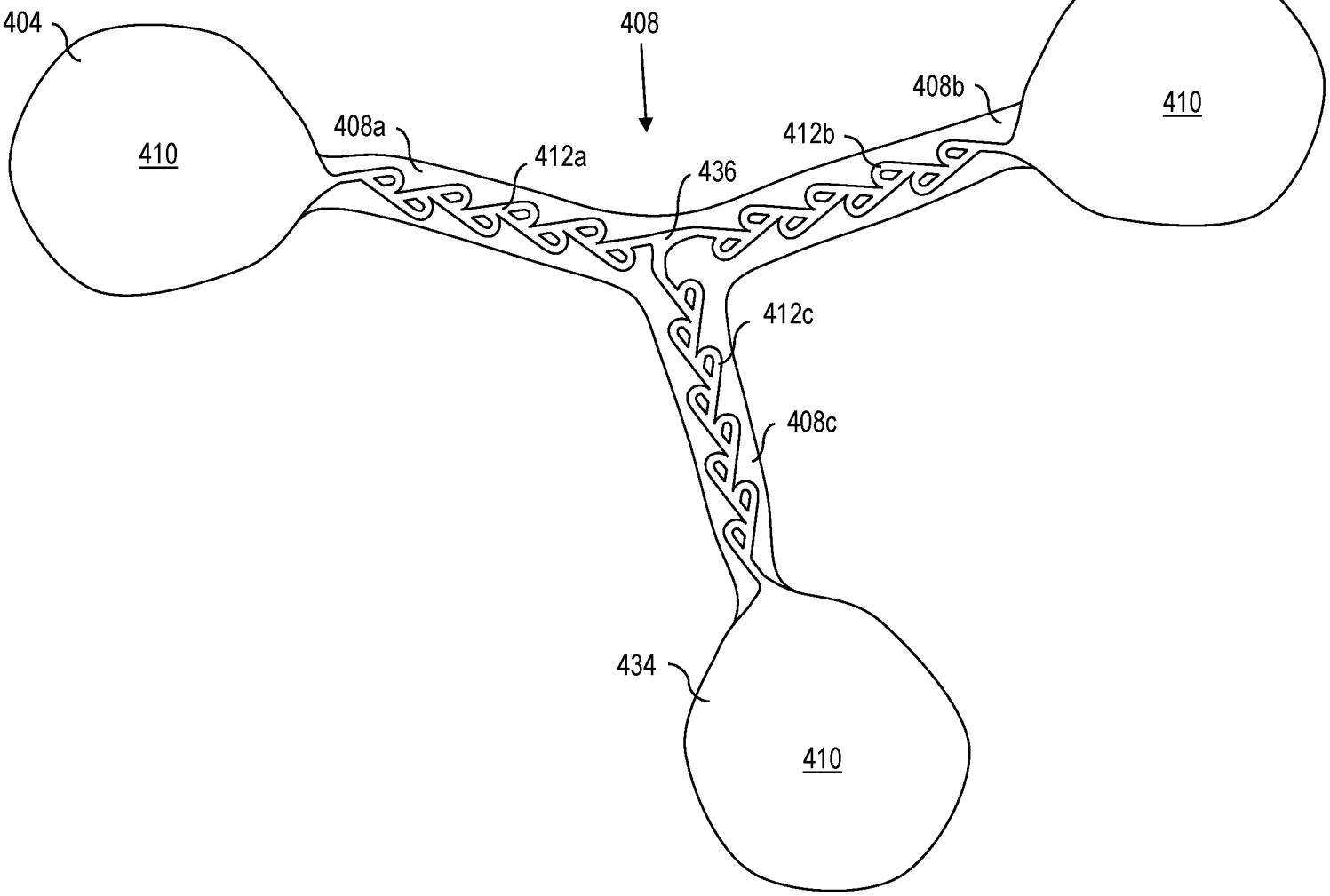
FIG. 4 is a drawing illustrating an embodiment of an impact reduction system for use in personal protective equipment, where the impact reduction system includes of three bladder systems coupled together by a passageway with three series of Tesla valves radiating from a common point, according to aspects of the present disclosure.
Figure 5:
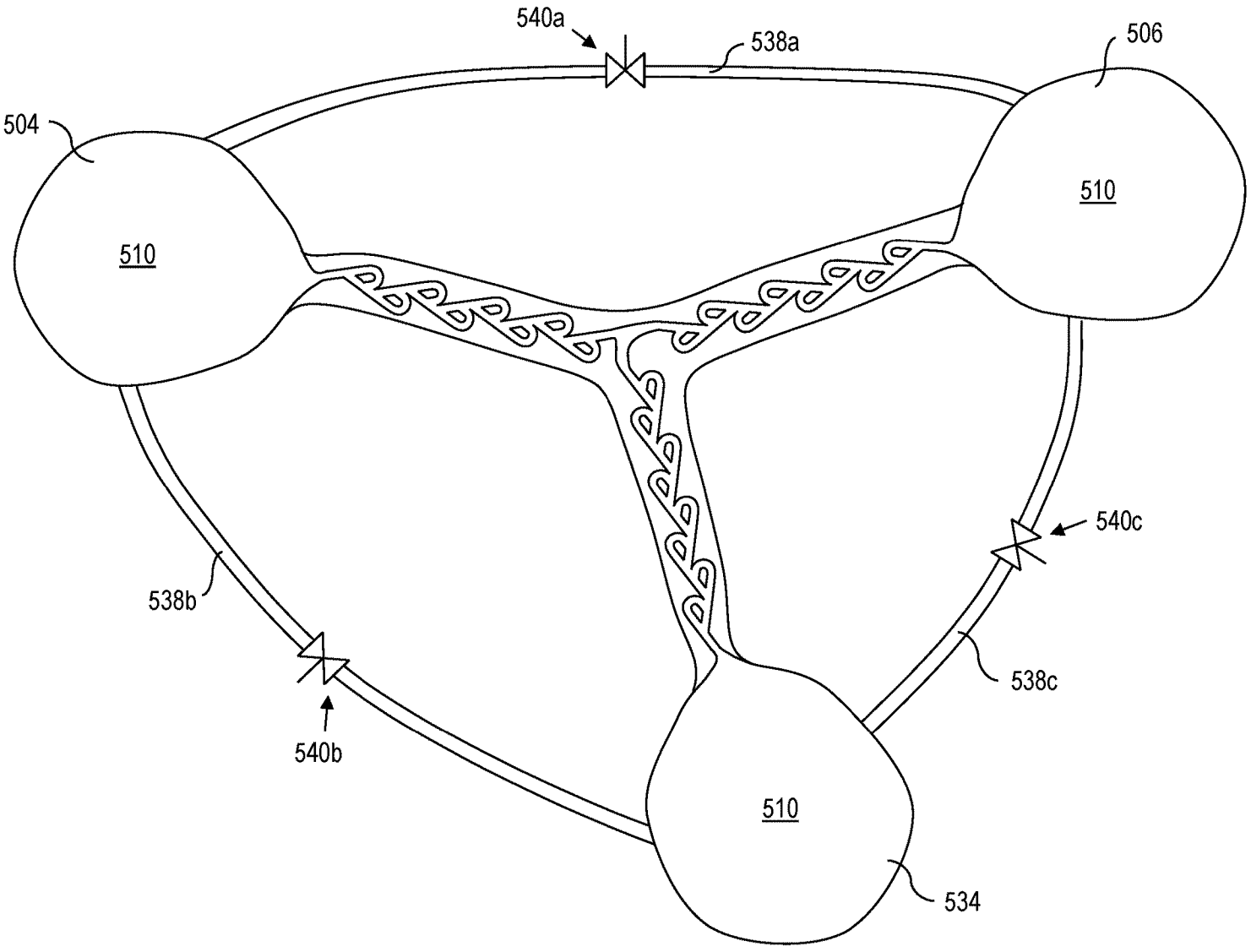
FIG. 5 is a drawing illustrating an embodiment of an impact reduction system for use in personal protective equipment, where the impact reduction system includes of three bladder systems coupled together by a passageway with three series of Tesla valves radiating from a common point, with a separate reset system, according to aspects of the present disclosure.

Turning now to FIG. 5, another embodiment of the impact reduction system 502 is shown. The embodiment of FIG. 5 functions similarly to the embodiment of FIG. 4 (discussed above), but includes reset passages 538*a-c*, each including a stop valve 540*a-c* that is normally closed. In some embodiments, there one stop valve in common to all the reset passages instead of individual stop valves. In the embodiment of FIG. 5, after the impact reduction system 502 incurs an impact and the fluid flows from one of the bladder systems to another, the impact reduction system 502 can be reset by opening the stop valves 540*a-c* to allow the fluid to achieve equilibrium in the bladder systems. For example, if each bladder system 504, 506, 534 holds one-hundred ml (milliliters) of fluid 510, and an impact occurs on the first bladder system 504 such that seventy ml of the fluid from the first bladder system is equally divided between the second and third bladder systems 506, 534, then there will be thirty ml of fluid in the first bladder system, one-hundred-thirty-five ml of fluid in the second bladder system, and one-hundred-thirty-five ml of fluid in the third bladder system.

By opening the stop valves 540*a-c* (or just the valves between the first and second bladder systems and the first and third bladder systems), the excess fluid will drain from the second and third bladder systems and back to the first bladder system such that there is one-hundred ml (or close to that amount) in all three bladder systems. The stop valves 540*a-c* are then closed, and the impact reduction system 502 is ready for use again.

Figure 6:
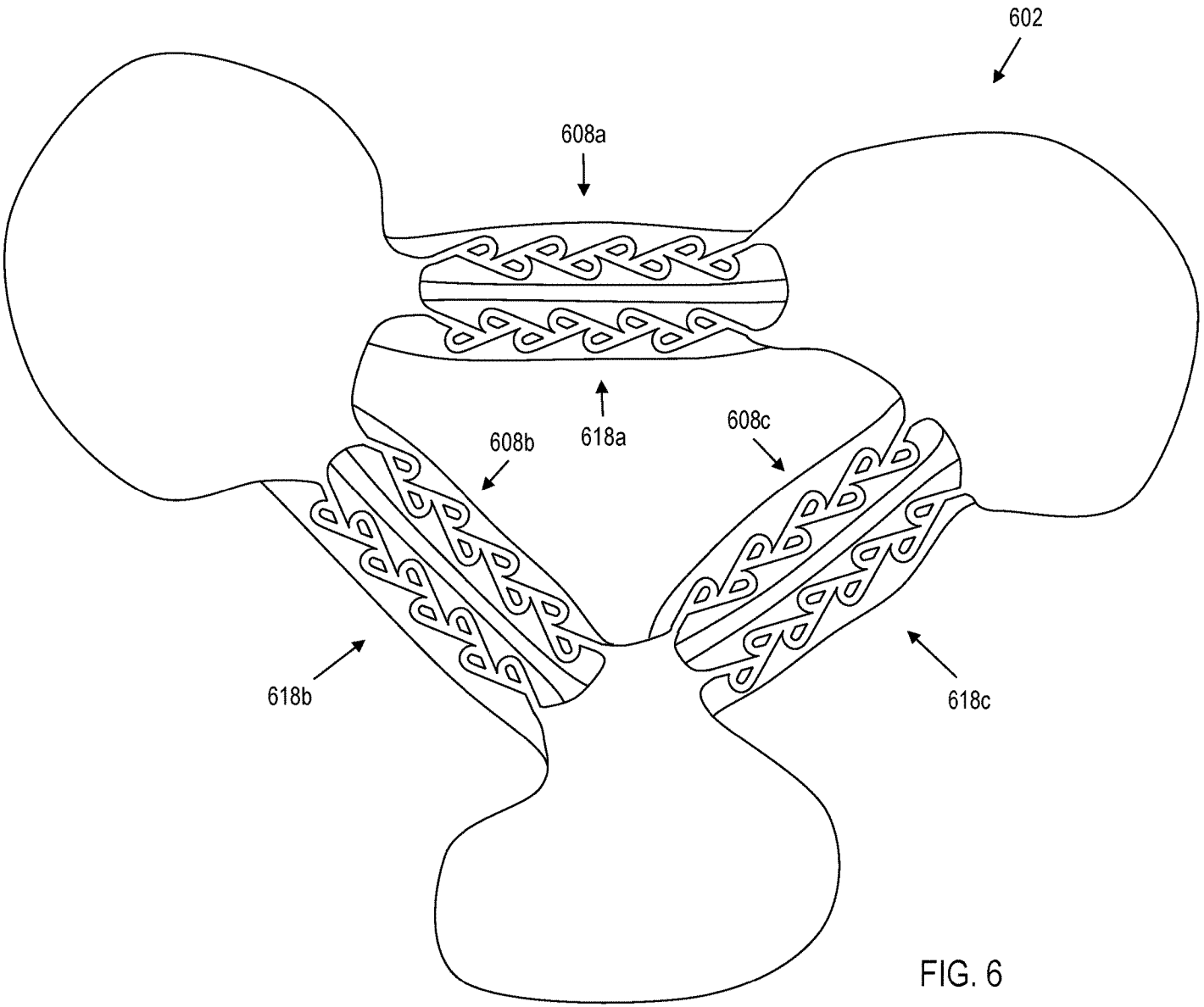
FIG. 6 is a drawing illustrating an embodiment of an impact reduction system for use in personal protective equipment, where the impact reduction system includes of three bladder systems coupled together by dual passageways, according to aspects of the present disclosure.

Turning to FIG. 6, another embodiment of the impact reduction system 602 is shown. Similar to the embodiment of FIG. 5, there are three bladder systems 604, 606, 634 coupled together by the passageways 608*a-c*, 618*a-c* as described in FIG. 2 to illustrate that any of the passageways described herein can be used with any number of bladder systems. For example, FIG. 4 illustrates multiple passageways 508*a-c* issuing from a common point 435, and the embodiment of FIG. 6 illustrates that the passageways 608*a-c*, 618*a-c* can have just two bladder systems: one on each end.

Figure 7:
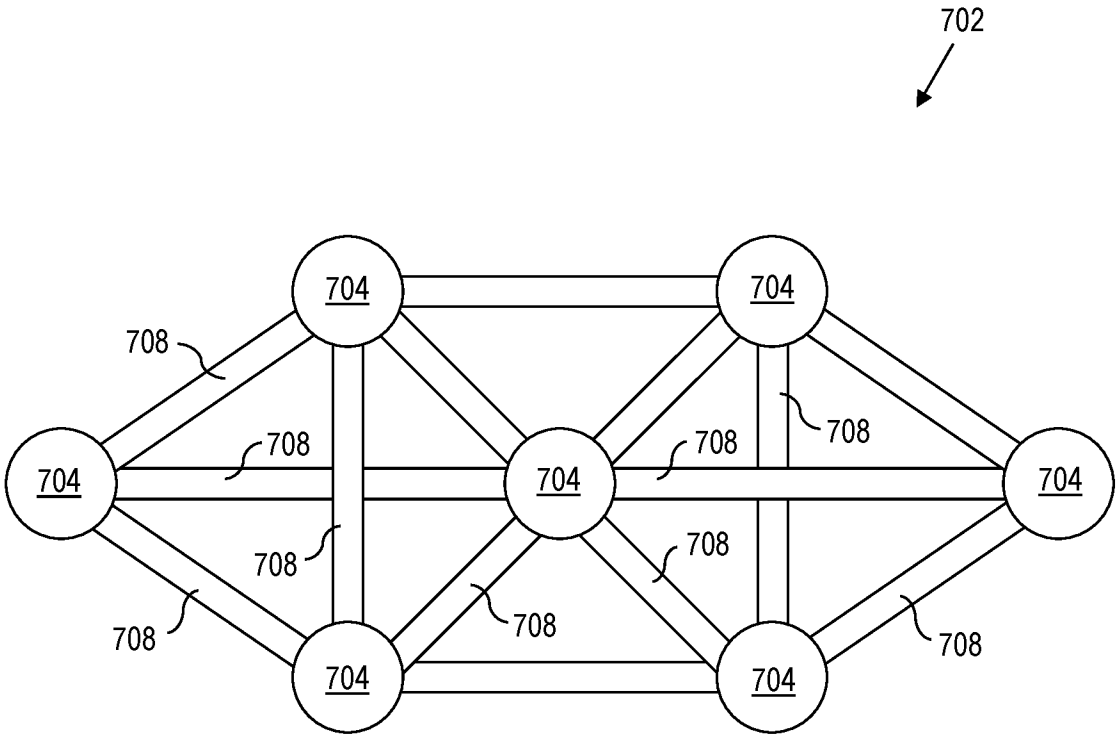
FIG. 7 is a drawing illustrating an embodiment of an impact reduction system for use in personal protective equipment, where the impact reduction system includes of multiple bladder systems coupled together by passageways, according to aspects of the present disclosure.

FIG. 7 is an embodiment of the impact reduction system 702 that illustrates that any number of bladder systems 704 may be coupled together using the passageways 708 of any of FIGS. 1-6 discussed herein.

Figure 8:
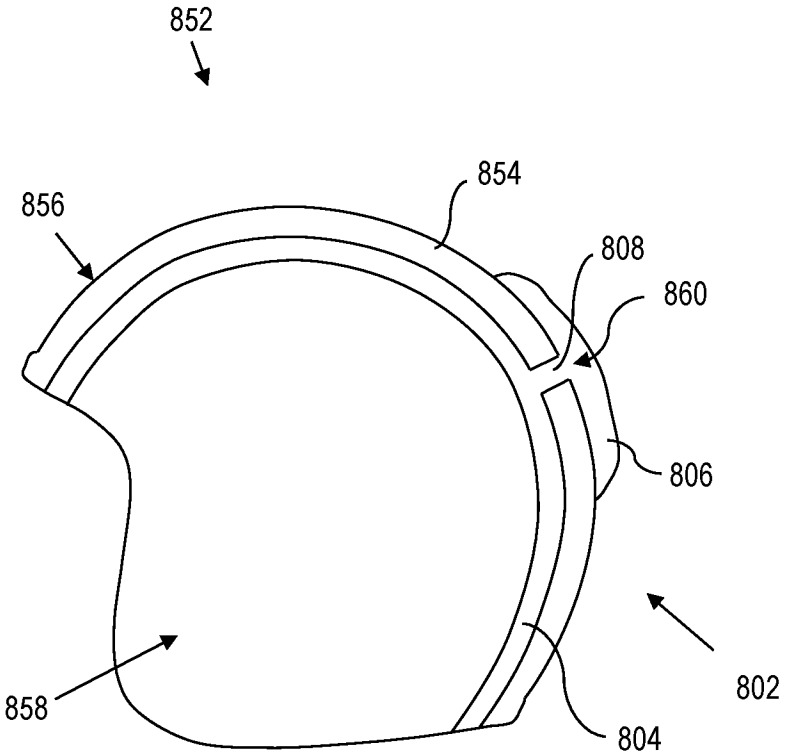
FIG. 8 is a drawing illustrating an embodiment of a protective equipment device having a bladder system and a passage system for dampening impacts where a bladder system is external to the device, according to various aspects of the present disclosure.

FIG. 8 illustrates an embodiment 852 of a personal protective device (in this case a helmet) that incorporates any of the embodiments of the impact reduction system 102, 202, 302, 402, 502, 602, 702 discussed herein. In the embodiment of FIG. 8, the helmet 852 (cutout) includes a hard shell 854 with an exterior surface 856 and an interior 858. An impact reduction system 802 is incorporated into the helmet such that a first bladder system 804 is in the interior 858 of the helmet 852 and a second bladder system 806 is on the exterior surface 856 of the helmet 852. An aperture 860 allows a passageway 808 to couple the first bladder system 804 to the second bladder system 806. As discussed above, the passageway 808 includes a series of Tesla valves 812 that resists flow of a liquid 810 in the first bladder system 804 to the second bladder system 806. The first bladder system is molded to fit contours of the interior 858 of the helmet 852. In some embodiments, there are multiple bladders in the first bladder system instead of one contiguous bladder (as discussed above).

When a user wears the helmet 852 and an impact occurs, the momentum associated with the impact is spread out over a longer time period, which reduces the force of impact, as discussed herein. The fluid 810 flows through the passageway 808 from the first bladder system 804 and fills the second bladder system 806. Note that as the second bladder system is external to the helmet 852, a third party (e.g., a medic) may see how filled the second bladder system 806 is to determine a severity of the impact: the more force of impact, the more fluid 810 will have made its way through the passageway 808.

Figure 9:
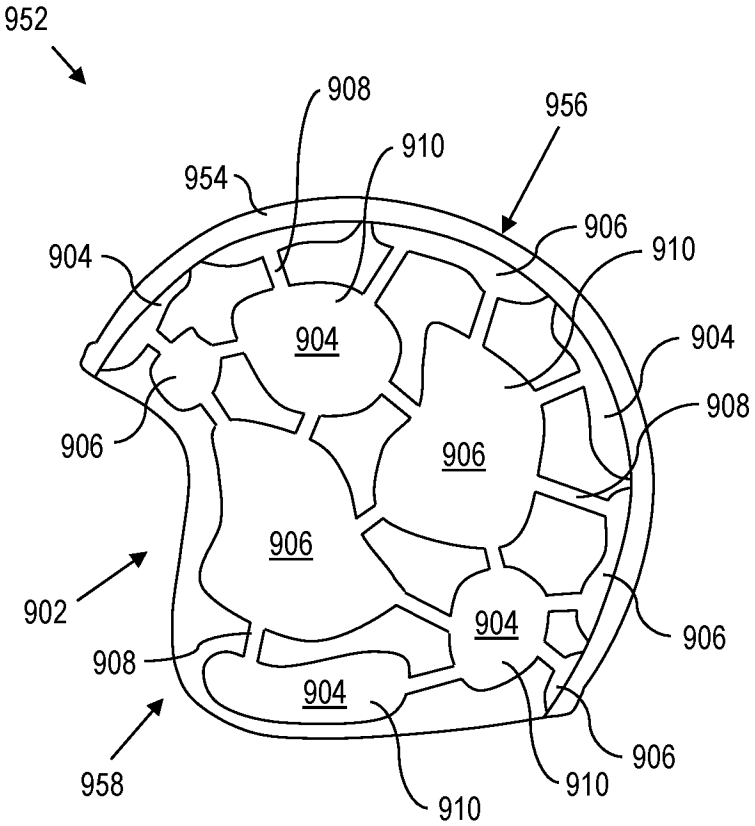
FIG. 9 is a drawing illustrating another embodiment of a protective equipment device having a bladder system and a passage system for dampening impacts, according to various aspects of the present disclosure, where the bladder systems are internal to the device, according to aspects of the present disclosure.

Turning to FIG. 9, another embodiment of a personal protective device (in this case another helmet) 952 is shown. The helmet 952 incorporates any of the embodiments of the impact reduction system 102, 202, 302, 402, 502, 602, 702 discussed herein. In the embodiment of FIG. 9, the helmet 952 includes a hard shell 954 with an exterior surface 956 and an interior 958. Unlike the embodiment of FIG. 8, in the embodiment of FIG. 9, all of the bladder systems are in the interior of the helmet 952. When a user wears the helmet 952 and an impact occurs, the momentum associated with the impact is spread out over a longer time period, which reduces the force of impact, as discussed herein. The fluid 910 flows through the passageway 908 from the first bladder system 904 and fills the second bladder system 906.

In this embodiment of the helmet 952, the fluid moves from one side of the helmet (e.g., left, right, front, back, etc.) to an opposite side of the helmet 952, which reinforces the opposite side if the user's head is jostled in that direction. For example, bladders coupled to the front of the helmet 952 (e.g., near a forehead of the user) are coupled to bladders coupled to the back of the helmet (e.g., near an occipital bone or base of a neck of the user).

If an impact occurs where the user's head is thrust forward, the bladders at the front will soften the impact (as discussed herein) and reinforce the back of the user's head if the user's head is then thrust backward.

In the embodiments of the helmets discussed herein, the series of Tesla valves in the passages also would reduce an impact of shockwaves as they travel through the helmet. For instance the Tesla valves will reduce vibrations of the shockwave by having the vibrations redirected via the Tesla valves. Further, more bladders on the interior of the helmets are better to spread the force of impact over a larger area. Moreover, using the bladders as discussed herein allow rotational forces to be displaced by the bladder being able to shear or slide. This results in an impact reduction system that protects from linear and rotational impact forces.

Figure 10:
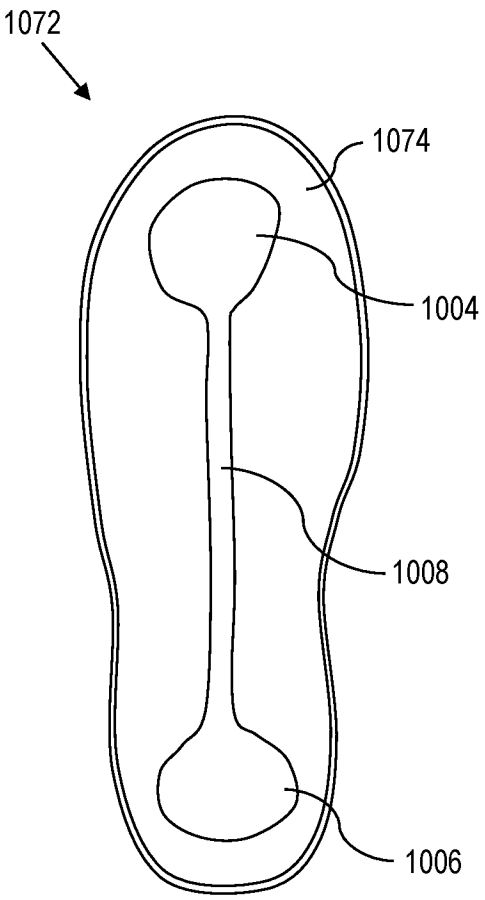
FIG. 10 illustrates a yet further embodiment of a protective equipment device embodied as a shoe having a bladder system and a passage system for dampening impacts, according to various aspects of the present disclosure.

Turning to FIG. 10, an embodiment 1072 of a personal protective device (in this case a shoe). The shoe includes a sole 1074 that includes any of the embodiments of the impact reduction system 102, 202, 302, 402, 502, 602, 702 discussed herein. The first bladder system 1004 is located on the sole 1074 at a position designated for a ball of a user's foot, and the second bladder system 1006 is located on the sole 1074 at a position designated for a heel of a user's foot. In various embodiments, the first and second bladder systems are switched. When a user wears the shoes 1072, the impact reduction system 1002 reduces impacts as the user's foot strikes the ground as the fluid flows in the passageway.

The embodiments of the impact reduction system 102, 202, 302, 402, 502, 602, 702 discussed herein may be used in any other personal protective devices to lessen the effect of impacts on a user.

Any of the features of any of the embodiments discussed herein may be used with any of the other embodiment discussed herein. The embodiments of the impact reduction discussed herein are closed systems that do not require any electronics to function as described herein (i.e., they are free from electronics and passive).

The impact reduction systems and personal protective devices described herein provide better impact reduction over existing solutions such as expanded polystyrene foam, crumple zones, etc. Further, the impact reduction systems are closed systems that can be reset after an impact, so the equipment may be used again, while many existing solutions are one-time use (e.g., crumple zones, deflectable materials, etc.). The bladders replicate a rotational impact benefit of slip plates and the Tesla valves help reduce linear impact as described herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. Aspects of the disclosure were chosen and described in order to best explain the principles of the invention and the practical application, and to enable others of ordinary skill in the art to understand the invention for various embodiments with various modifications as are suited to the particular use contemplated.

The invention claimed is:

1. A personal protective device with an impact reduction system, the impact reduction system comprising:

a first bladder system including a fluid;

a second bladder system;

a passageway that couples the first bladder system to the second bladder system, wherein the passageway includes:

a first series of Tesla valves that resist flow of the fluid from the first bladder system to a common point of the passageway when an impact occurs to the first bladder system; and a second series of Tesla valves that resist flow of the fluid from the second bladder system to the common point of the passageway when an impact occurs to the second bladder system.

2. The personal protective device of claim 1, wherein the impact reduction system is a closed system.

3. The personal protective device of claim 1, wherein the impact reduction system is free from electronic devices.

4. A helmet comprising:

a hard shell with an exterior surface and an interior; and an impact reduction system comprising:

a first bladder system in the interior of the shell, where the first bladder system includes a fluid;

a second bladder system;

a first passageway that couples the first bladder system to the second bladder system, wherein the first passageway includes a series of Tesla valves that resist flow of the fluid from the first bladder system to the second bladder system when an impact occurs to the first bladder system; and a second passageway that couples the first bladder system to the second bladder system, wherein the second passageway includes a series of Tesla valves that resist flow of the fluid from the second bladder system to the first bladder system after the fluid has passed to the first bladder system.

5. The helmet of claim 4, wherein the second bladder system is on the exterior surface of the hard shell.

6. The helmet of claim 4, wherein:

the first bladder system includes multiple bladders;

the first passageway is a system of passages that couples the multiple bladders of the first bladder system to the second bladder system; and the second passageway is a system of passages that couples the second bladder system to the multiple bladders of the first bladder system.

7. The helmet of claim 6, wherein the first passageway includes:

a number of inlets equal to a number of bladders in the first bladder system, wherein each of the bladders of the first bladder system feeds one inlet of the first passage; and a single outlet such that the inlets feed the outlet.

8. The helmet of claim 6, wherein the first passageway includes:

a number of inlets equal to a number of bladders in the first bladder system, wherein each of the bladders of the first bladder system feeds one inlet of the first passage; and a number of outlets equal to a number of bladders in the second bladder system, wherein each outlet feeds the second bladder system.

9. The helmet of claim 6, wherein:

the second bladder system includes multiple bladders;

the first passageway is a system of passages that couples the multiple bladders of the second bladder system to the first bladder system; and the second passageway is a system of passages that couples the first bladder system to the multiple bladders of the second bladder system.

10. The helmet of claim 9, wherein the number of bladders of the first bladder system is equal to the number of bladders of the second bladder system.

11. The helmet of claim 9, wherein the number of bladders of the first bladder system is not equal to the number of bladders of the second bladder system.

12. The helmet of claim 4, wherein:

the first bladder system is a single first bladder; and the second bladder system is a single second bladder.

13. The helmet of claim 4, wherein the impact reduction system is a closed system.

14. The helmet of claim 4, wherein the impact reduction system is free from electronic devices.

15. A helmet comprising:

a hard shell with an exterior surface and an interior; and an impact reduction system comprising:

a first bladder system in the interior of the shell, where the first bladder system includes a fluid;

a second bladder system, wherein the second bladder system is disposed on the exterior surface of the helmet;

a passageway that couples the first bladder system to the second bladder system, wherein the passageway includes a series of Tesla valves that resist flow of the fluid from the first bladder system to the second bladder system when an impact occurs to the first bladder system.

16. The helmet of claim 15, wherein:

the passageway that couples the first bladder to the second bladder is a first passageway; and the impact reduction system further comprises a second passageway that couples the first bladder system to the second bladder system, wherein the second passageway includes a series of Tesla valves that resist flow of the fluid from the second bladder system to the first bladder system after the fluid has passed to the first bladder system.

17. The helmet of claim 15, wherein:

the first bladder system includes multiple bladders; and the passageway is a system of passages that couples the multiple bladders of the first bladder system to the second bladder system.

18. The helmet of claim 17, wherein the passageway includes:

a number of inlets equal to a number of bladders in the first bladder system, wherein each of the bladders of the first bladder system feeds one inlet of the passageway; and a single outlet such that the inlets feed the outlet.

19. The helmet of claim 15, wherein the impact reduction system is a closed system.

20. The helmet of claim 15, wherein the impact reduction system is free from electronic devices.

* * * * *